US008434570B2

(12) United States Patent
Boulet

(10) Patent No.: US 8,434,570 B2
(45) Date of Patent: May 7, 2013

(54) DRILL PACKER MEMBER, DRILL PIPE, AND CORRESPONDING DRILL PIPE STRING

(75) Inventor: Jean Boulet, Paris (FR)

(73) Assignee: Vam Drilling France, Cosne Cours sur Loire (FR)

( * ) Notice: Subject to any disclaimer, the term of this patent is extended or adjusted under 35 U.S.C. 154(b) by 357 days.

(21) Appl. No.: 12/918,525

(22) PCT Filed: Feb. 19, 2009

(86) PCT No.: PCT/FR2009/000187

§ 371 (c)(1),
(2), (4) Date: Aug. 20, 2010

(87) PCT Pub. No.: WO2009/115687

PCT Pub. Date: Sep. 24, 2009

(65) Prior Publication Data

US 2010/0326738 A1 Dec. 30, 2010

(30) Foreign Application Priority Data

Feb. 21, 2008 (FR) ..... 08 00942
Nov. 10, 2008 (FR) ..... 08 06262

(51) Int. Cl.
*E21B 17/22* (2006.01)
*E21B 17/10* (2006.01)

(52) U.S. Cl.
USPC ..... 175/323; 175/320; 175/325.1

(58) Field of Classification Search ..... 175/320, 175/323, 324, 325.1–325.5
See application file for complete search history.

(56) References Cited

U.S. PATENT DOCUMENTS

| | | | | |
|---|---|---|---|---|
| 1,460,632 | A | 7/1923 | Wigle et al. | |
| 7,182,160 | B2 * | 2/2007 | Boulet | 175/320 |
| 2003/0136587 | A1 | 7/2003 | Boulet | |
| 2003/0221872 | A1 | 12/2003 | Boulet | |
| 2004/0060699 | A1 | 4/2004 | Rastegar | |
| 2004/0195009 | A1 | 10/2004 | Boulet | |

FOREIGN PATENT DOCUMENTS

| | | |
|---|---|---|
| FR | 2 824 104 | 10/2002 |
| FR | 2 835 014 | 7/2003 |
| FR | 2 851 608 | 8/2004 |

OTHER PUBLICATIONS

U.S. Appl. No. 13/060,965, filed Feb. 25, 2011, Boulet.

* cited by examiner

*Primary Examiner* — Giovanna Wright
(74) *Attorney, Agent, or Firm* — Oblon, Spivak, McClelland, Maier & Neustadt, L.L.P.

(57) ABSTRACT

An element for a drill string includes at least one zone bearing on a wall of the drilled hole, the bearing zone including at least one bearing section with an external diameter greater than the diameter of the other portions of the element, and two activation zones substantially adjacent to the bearing zone and disposed upstream and downstream of the bearing zone. The activation zones include a plurality of grooves with a generally helical shape about the axis of the element. The bearing zone includes two guide sections in a shape of a convex rounded body of revolution, disposed upstream and downstream of the bearing section in a manner adjacent to the bearing section, and tangential to the bearing section and to the activation zones.

43 Claims, 12 Drawing Sheets

DRILL PACKER MEMBER, DRILL PIPE, AND CORRESPONDING DRILL PIPE STRING

BACKGROUND OF THE INVENTION

1. Field of the Invention

The invention relates to the field of prospecting and operating oil or gas wells in which rotary drill strings constituted by drill pipes and possibly other tubular components coupled end-to-end are used depending on the drilling requirements.

More particularly, the invention concerns a profiled part, such as a drill pipe, for rotary drilling equipment disposed in a drill pipe section or a heavy weight drill pipe or a drill collar or a drill stabilizer or a cross-over sub with a different diameter or thread type.

Such drill pipe sections associated with other components of the drill string (drill collars, stabilizers, etc) mean that in particular, deflected wells can be drilled, i.e. wells wherein the inclination with respect to the vertical or the horizontal can be varied during drilling. Deflected wells can currently reach depths of the order of 2 to 8 km and horizontal distances of the order of 2 to 15 km.

In the case of deflected wells comprising practically horizontal sections, the frictional torques due to rotation of the drill strings in the wells can reach very high values during drilling. The frictional torques may mean that the equipment used or the drilling objectives have to be reviewed. Further, it is very often difficult to lift the debris produced by drilling because of sedimentation of the debris produced in the drilled hole, in particular in the portion of the hole which is highly inclined with respect to the vertical. This results in poor cleaning of the hole and an increase in both the coefficient of friction of the drill pipes of the drill pipe section within the drilled hole and the contact surfaces between the drill pipes and the walls of the hole.

2. Description of the Related Art

FR-2 760 783 proposes a profile for a drill pipe with a collar which comes into contact with the wall of the drilled hole and which can remain stationary in rotation with respect to the wall, and grooved sections which can activate circulation of the drilling fluid.

More recently, FR-2 824 104 concerns a profiled element for rotary drilling equipment comprising a zone which bears on the wall of the drilled hole, a turbulence zone to produce activation of the circulation of a drilling fluid in the drilled hole around the drilling equipment, and a deflection zone adjacent to the bearing zone and to the turbulence zone extending in an axial direction of the profiled element and comprising at least one surface which is inclined with respect to the drilling axis, wherein the meridian line in an axial plane moves away from the axis of the profiled element in the direction moving from bottom to top in the service position of the profiled element in the drilled hole.

That type of device has proved satisfactory until recently. However, there is now a need to provide drill strings which are particularly robust, multifunctional and designed for drilling at considerable depths and at considerable departures.

The invention aims to improve the situation.

BRIEF SUMMARY OF THE INVENTION

The drill string element for drilling a hole with circulation of a drilling fluid around said element and in a direction moving from the bottom of a drilled hole towards the surface comprises at least one zone for bearing on the wall of the hole during drilling, the bearing zone being provided on its external surface with at least one bearing section with an external diameter which is greater than the diameter of the other portions of the element, and two activation zones substantially adjacent to the bearing zone and disposed upstream and downstream of the bearing zone, said activation zones comprising a plurality of grooves which are generally helical in shape about the axis of said element. The activation zones are integral with the bearing zone. The bearing zone comprises two guide sections in the form of a convex rounded body of revolution, disposed upstream and downstream of the bearing section and adjacent to the bearing section. The guide sections are tangential to the bearing section and to the activation zones.

A drill string element for drilling a hole with circulation of a drilling fluid around said element and in a direction moving from the bottom of a drilled hole towards the surface, forms a connection between a drill string or a heavy weight drill pipe section and a bottom hole assembly. The element comprises a first end comprising an external surface with a first diameter and a female thread, a second end comprising an external surface having a second diameter and a male thread, the first diameter being less than or equal to the second diameter, at least one zone bearing on the wall of the hole during drilling, the bearing zone being provided with at least one bearing section with a cylindrical external surface and with an external diameter which is greater than the diameter of the other portions of the element, and two activation zones substantially adjacent to the bearing zone and disposed upstream and downstream of the bearing zone. Said activation zones comprise a plurality of grooves which are generally helical in shape about the axis of said element. The bearing zone comprises two guide sections in the form of a convex rounded body of revolution, disposed upstream and downstream of the bearing section and adjacent to the bearing section. Said guide sections are tangential to the bearing section and to the activation zones.

The term "drill string element" means not only components of the drill string (drill pipes, etc), but also the constituent portions of said components such as tool joints, for example, which may be attached to the ends of the drill pipes using any means such as by welding, for example, and which allow the drill pipes to be connected together by makeup.

The terms "upstream" and "downstream" as used herein refer to the direction of circulation of drilling fluid in the annular space around the element.

Except if otherwise stated, the term "drill pipe section" means the portion of the drill string including both standard and heavy weight drill pipes.

The Applicant has established that the static and dynamic loads in rotation are reduced, the axial weight on going in and pulling out the string from the well are decreased, the capacity to transmit weight to a tool is increased, the debris pull-out capacity is increased, the safety margin for over-tension and over-torque is better, the critical buckling conditions are reduced, the fatigue strength under alternating flexion is increased, wear and abrasion of the drill string are reduced, the working capacity in debris when pulling out is better, meaning that the risk of blocking is reduced, the mechanical integrity of the threaded connections is maintained well, the hydraulic pressure drops are reduced, mud and debris flow better around the drill pipe, wear by abrasion of the internal wall of the drilled well is reduced, there is a large reduction in the risks of sticking due to differential pressure, especially when the hydrostatic pressure of the mud is greater than the pressure prevailing in the material, for example rock, during drilling, the risks of the drill pipe section jamming during a pull-out procedure are greatly reduced, and the surface qualities of the walls of the drilled hole are improved.

A drill pipe may comprise at least one element as described above and a tube welded end-to-end onto an end of said element which is free of a thread. The tube may be welded to the element by friction. Said element may be machined from a short, large diameter piece while the tube may have a smaller diameter, resulting in a very substantial reduction in the mass of metal to be machined and of the quantity of machining scrap. Said short piece may be of the order of 0.3 to 1 meter long.

The drill pipe section preferably comprises a large proportion of drill pipes as described above, for example at least 80%, preferably more than 95%. A drill pipe section composed of drill pipes as described above can benefit from the effects mentioned above. The drill pipe section may comprise at least two adjacent drill pipes.

A drill string stabilizer for drilling a hole with circulation of a drilling fluid around said element and in a direction going from the bottom of the drilled hole to the surface may comprise at least one zone for bearing on the wall of the hole during drilling, the bearing zone being provided with at least one bearing section with an external diameter which is greater than the diameter of the other portions of the stabilizer, and two activation zones which are substantially adjacent to the bearing zone and disposed upstream and downstream of the bearing zone, said activation zones comprising a plurality of grooves which are generally helical in shape about the axis of said stabilizer. The activation zones are integral with the bearing zone. The bearing zone comprises at least two guide sections with a convex rounded shape disposed upstream and downstream of the bearing section and adjacent to the bearing section. The guide sections are tangential to the bearing section and to the activation zones. Circulation grooves which are generally helical in shape are provided about the axis of said stabilizer on the external surface of the bearing zone.

BRIEF DESCRIPTION OF THE DRAWINGS

The present invention will be better understood from the following detailed description of some embodiments which are given by way of non-limiting examples and are illustrated in the accompanying drawings, in which.

DETAILED DESCRIPTION OF THE INVENTION

As can be seen in FIGS. 1 to 12, the profiled drill pipe 1 is generally formed as a body of revolution about an axis 2 which substantially constitutes the drilling axis, when the profiled drill pipe 1 of a drill pipe section is in the service position inside a drilled hole produced by a tool such as a drill bit disposed at the end of the drill string. The axis 2 is the axis of rotation of the drill pipe section. The profiled drill pipe 1 has a tubular shape; a channel 3 formed as a substantially cylindrical body of revolution is provided in the central portion of the profiled drill pipe 1.

Figure 1:
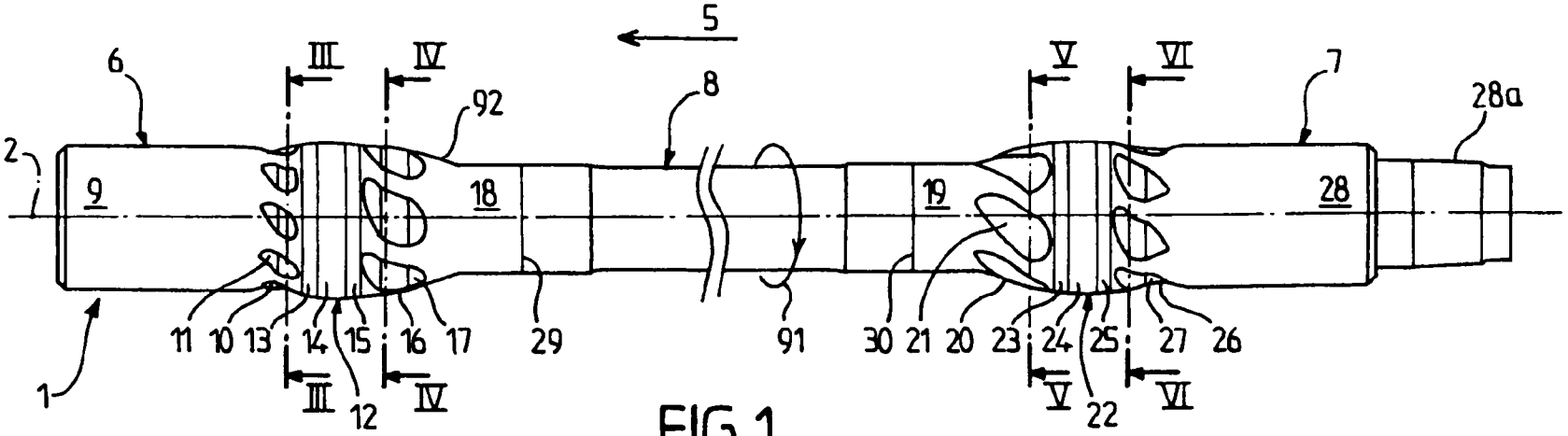
FIG. 1 is a side view of a drill pipe (component of a drill string) comprising a threaded connector element at each of its two ends.
Figure 2:
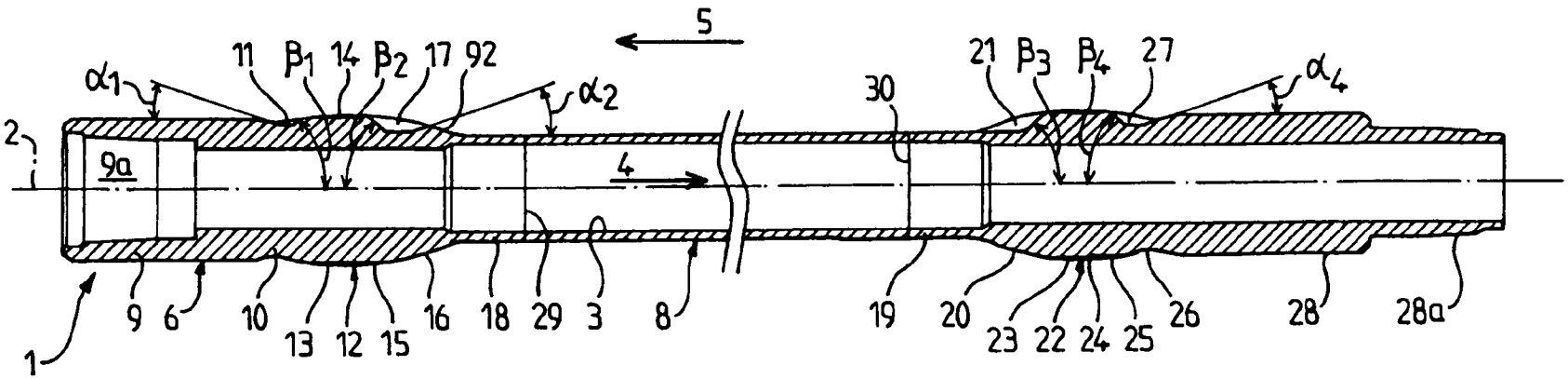
FIG. 2 is an axial sectional view of the drill pipe of FIG. 1.

The components of the drill string (in particular the drill pipes of the drill pipe section illustrated in FIGS. 1 to 12) are produced in a tubular shape and are connected together end-to-end, such that their central channels 3 are positioned in mutual extension and constitute a continuous central space for circulation of a drilling fluid from top to bottom, as indicated by the arrow 4 of FIG. 2 between the surface from which drilling is carried out to the bottom of the drilled hole where the drilling tool operates. The drilling fluid or mud then rises in the annular space defined between the wall of the drilled hole and the external surface of the drill pipe section, see arrow 5. A drill string may comprise drill pipes, heavy weight drill pipes, drill collars, stabilizers or connections. The drill pipes are connected end-to-end by makeup into a drill pipe section which constitutes a substantial or even preponderant part of the length of the drill string.

As it rises outside the drill pipe section, the drilling fluid entrains debris from the geological formations traversed by the drilling tool to the surface from which drilling is carried out. The drill pipe section is designed to facilitate upward circulation of drilling fluid in the annular space between the drill pipe and the well wall. It is desirable to entrain the drilling debris effectively and to sweep the wall of the drilled hole and the bearing surfaces of the to facilitate the advance of the drill pipe section inside the hole.

The characteristics of a drill pipe section and more generally a component of the drill string contribute to the fundamental properties of quality, performance and safety of the general drilling process whether this is during the drilling phases proper or during phases when tripping is carried out between the bottom and the surface. Changes in prospecting for hydrocarbons demands the creation of trajectories which are more and more complex and are subjected to ever more extreme geological conditions. Currently, hydrocarbons are being prospected at depths which are routinely over 4 km and at horizontal distances with respect to the fixed installation which may exceed ten kilometers.

The Applicant has determined that the mechanical and hydraulic characteristics at the contact points between the component of the drill string and the walls of the drilled hole are very important. In fact, the string rubs in rotation and in translation against the wall of the drilled hole. The friction causes slow but nevertheless significant wear of the components of the string and relatively rapid wear of the walls of the drilled hole, resulting in an increase in the diameter of the drilled hole and an increase in the volume of debris which may prove to be considerable for very long holes. Further, blocking due to an increase in the mass of debris between the drilled hole and the string has to be avoided.

The Applicant has developed a novel universal profile which can very substantially reduce the axial coefficients of friction from the bottom to the surface and from the surface to the bottom, and of rotation while allowing dynamic cleaning of the entire hole during drilling and destruction of accumulations of debris which may be produced during drill pipe section pull-out trips. The profile can drastically reduce wear by abrasion of the string and in particular the drill pipe section and reduce wear of the walls of the drilled hole by abrasion. The profile can also prevent contact between the zones of maximum stress in the made up connections. The profile means that the service life of equipment can be increased, and its mechanical strength during drilling and tripping stages is maintained.

The profiled drill pipe 1 may be produced from high strength steel in a monoblock form, or it may be produced in sections and then welded together. More particularly, the profiled drill pipe 1 may comprise two profiled end sections 6 and 7 which are relatively short forming tool joints for connecting drill pipes and a central tubular section 8 with a length which may exceed ten meters when welded together. The central section 8 may have an external diameter which is smaller than the end sections. Fabrication of the long central section 8 from the short end sections 6, 7 can significantly reduce the amount of waste, in particular machining chips or turnings. In this manner, a considerably higher material yield is obtained. The central section 8 may be in the form of a tube with a substantially constant bore and with a substantially constant external diameter (nominal diameter of the drill pipe section), possibly with an excess thickness at the ends near the sections 6 and 7 to facilitate connection of said sections 6 and 7 by welding.

In general, the description below is given from the free end of the section 6 to the free end of the section 7. The section 6 (female tool joint) comprises a female connection portion 9 with an external annular cylindrical surface comprising a bore provided with a female thread 9*a* for connection to a male thread of another drill pipe 1. The female thread 9*a* may be tapered, for example in accordance with API specification 7, or in accordance with one of the Applicant's patents, for example U.S. Pat. Nos. 7,210,710, 6,513,840. The connection portion 9 constitutes the free end of the end section 6 of the drill pipe 1.

Figure 3:
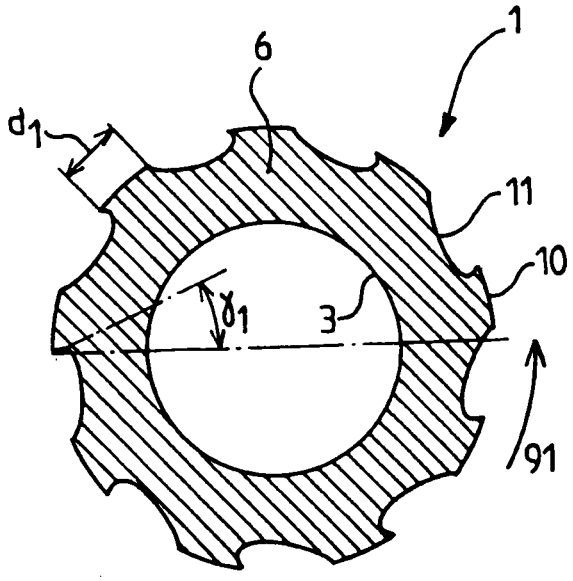
FIG. 3 is a sectional view along 3-3 of FIG. 1.

The end section 6 then comprises, on an external surface, an activation zone 10 a sectional view of which is shown in FIG. 3. The activation zone 10 comprises an external surface which is tangential to the external cylindrical surface of the connection portion 9, but may have a very slight annular recess with respect to the external diameter of the connection portion 9, then an increasing external diameter. The activation zone 10 comprises a plurality of grooves 11 formed as a helix and having a general shape (including an inclination) which encourages mud to rise in the direction of rotation of the drill pipe section, said direction of rotation being shown in FIGS. 1 and 3 to 6 by the arrow 91. The grooves 11 extend axially from the external cylindrical surface of the connection portion 9 to near the end of the activation zone 10. The angle of inclination of the helix of the grooves 11 with respect to the axis 2 may be in the range 7 to 45 degrees.

The bottom of the grooves 11 comprises a portion 11*a* with a decreasing diameter with respect to the connection portion 9, an annular bottom 11*b* of short length and an inclined portion 11*c* on the side opposite to the connection portion 9 then rejoins the external diameter of the activation zone 11. The annular recess in the external surface of the activation zone 10 is located substantially at the inclined portion 11*a* of the groove 11. As can be seen in FIG. 3, the grooves 11 have a unsymmetrical profile in the form of a scoop with an obtuse angle with respect to the external cylindrical surface of the activation zone 10 on one side and an acute angle on the opposite side. The acute angle may be provided on the back side or trailing side of the grooves in the direction of rotation of the drill pipe section (arrow 91). It will be recalled that a drill pipe section is always driven in rotation in the same direction in order to prevent the threaded joints from unscrewing. The obtuse angle provided on the front side or leading side of the grooves is designed to facilitate entry of fluid into the grooves 11. The grooves 11 provide a debris scooping function due to their unsymmetrical profile.

More particularly, the activation zone 10 may be provided with grooves 11 in a number in the range seven to ten, for example nine. The axial length of the portion 11*a* may be in the range 10 to 70 mm, preferably in the range 35 to 45 mm, for example 39 mm. The axial length of the central portion 11*b* may be in the range 5 to 40 mm, preferably in the range 10 to 15 mm, for example 11 mm. The angle $\alpha 1$ of the first portion 11*a* with respect to the axis may be in the range 10° to 30°, preferably in the range 15° to 25°, for example 20°. The angle $\beta 1$ of the portion 11*c* may be in the range 30° to 60°, preferably in the range 40° to 50°, for example 45°. The fillet radii between said portions may be in the range 3 to 10 mm. The depth of the grooves 11 may be in the range 5 to 20 mm, preferably in the range 10 to 15 mm. The acute angle on the trailing edge of the groove 11, complementary to $\gamma_1$, may be in the range 50° to 80°, preferably in the range 60° to 70°, for example 65°. The distance d1 between two grooves 11 on the exterior of the activation portion 10 may be in the range 20 to 40 mm, for example in the range 25 to 30 mm. The activation zone 10 provides a mud and debris recirculation effect during drilling (rotational drop-in of drill pipe section) and scrapes or back reams the walls of the hole when the drill pipe section is pulled out.

Next, the drill pipe 1 comprises a bearing zone 12 on its external surface, moving away from the connection portion 9. The bearing zone 12 comprises a guide portion 13, a central bearing portion 14 and a guide portion 15. In the direction of flow 5 of drilling mud outside the drill pipe 1, the guide section 13 is downstream and the guide section 15 is upstream. The bearing zone 12 may have an axial length of the order of 50 to 110 mm, preferably of the order of 70 to 80 mm. The central bearing portion 14 is in the shape of a cylindrical body of revolution with an external diameter which is greater than the external diameter of the other portions of the drill pipe 1.

The external shape of the guide sections 13 and 15 is as a rounded body of revolution, for example toroidal, ogival or ellipsoidal. The guide portions 13 and 15 are externally tangential to the central bearing portion 12. The guide portion 13 is externally tangential to the external surface of the activation zone 10. The guide portion 15 is externally tangential to the activation zone 16 described below. The length of the bearing section 14 may be of the order of half the length of the bearing zone 12. The guide portions 13 and 15 may each have a length of the order of a quarter of the length of the bearing zone 12. In the case of a toroidal shape, the guide portions 13 and 15 may have a radius of curvature of the order of 50 to 100 mm, preferably in the range 70 to 80 mm. The bearing zone 12, in particular the bearing section 14, may be produced in the form of a coating or facing formed from a material which is harder than the remainder of the drill pipe 1. The hard material may be composed of chromium or tungsten carbide. The hard material may have a thickness in the range 1 to 10 mm, for example 2 to 4 mm. Said hard material is in the form of a hard coating which may be supplied by a welding or thermal projection operation (for example in a flame or a plasma). The bearing zone 12 is provided to withstand axial and rotational friction against the wall of the drilled hole. The bearing zone 12, in particular the profile of the guide portions, allows the fluid to generate a fluid bearing effect.

The activation zone 16 disposed upstream of the bearing zone 12 in the direction of flow of the drilling mud outside the drill pipe 1 has an external diameter which generally increases in the direction of flow of the drilling mud in the direction of arrow 5. The external shape may, for example, be as a convex ovoid. The activation zone 16 connects tangentially to one side of the guide portion 15 of the bearing zone 12 and may connect on the other side to a tapered surface to vertically support the drill pipe 1 before connecting it to another drill pipe 1 (elevator taper). The activation zone 16 comprises a plurality of grooves 17 with a shape generally similar to that of the grooves 11 and with different dimensions. The grooves 17 may be in the range four to eight in number, for example six. The activation zone 16 ensures that mud and debris are scooped up to recirculate mud during drilling (dropping drill string). To increase the axial speed of the mud between the upstream activation zone 16 and the downstream activation zone 10 and thus the mud recirculation effect, the inclination to the axis of the helix of grooves 11 located downstream of the grooves 17 may be smaller than that of the grooves 17.

A groove 17 comprises a downstream portion 17*a* close to the guide portion 15, a central portion 17*b* with a cylindrical bottom and an upstream portion 17*c* with a diameter that decreases in the direction of the arrow 5. The downstream portion 17*a* may have an angle $\beta_2$ with respect to the axis 2 which is in the range 30° to 60°, preferably in the range 40° to 50°, for example 45°. The upstream portion 17*c* may have an angle $\alpha_2$ with respect to the axis 2 which is in the range 10° to 30°, preferably in the range 15° to 25°, for example 20°. The axial length of the central portion 17*b* may be in the range 20 to 60 mm, more preferably in the range 30 to 40 mm, for example 36 mm. The axial length of the upstream portion 17*c* may be in the range 10 to 50 mm, preferably in the range 20 to 30 mm, for example 24 mm. The central portion 17*b* may have a diameter which is lower than the diameter of the central portion 11*b* of the grooves 11 of the activation zone 10. The grooves 17 may have a depth which is greater than the depth of the grooves 11, preferably more than two times greater. The depth of the grooves 17 may be in the range 20 to 30 mm, preferably in the range 25 to 28 mm. Preferably, the thickness of the material between the cylindrical bottom 17*b* of the grooves and the bore 3 is greater than that of the connection zone 18 described below. As an example, the groove bottom diameter may be greater than or equal to the external diameter of the connection zone 18.

Figure 4:
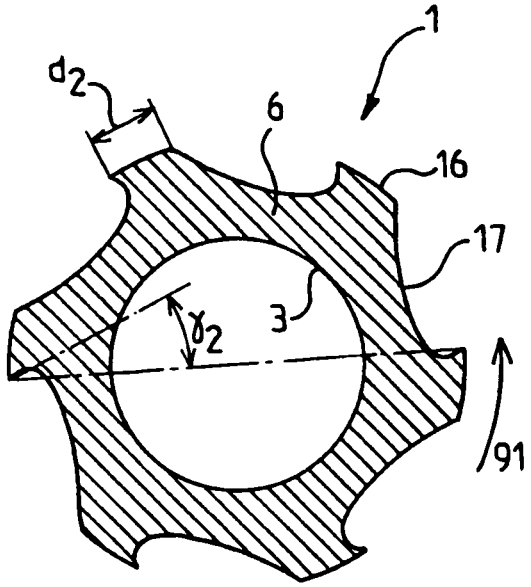
FIG. 4 is a sectional view along 4-4 of FIG. 1.
Figure 5:
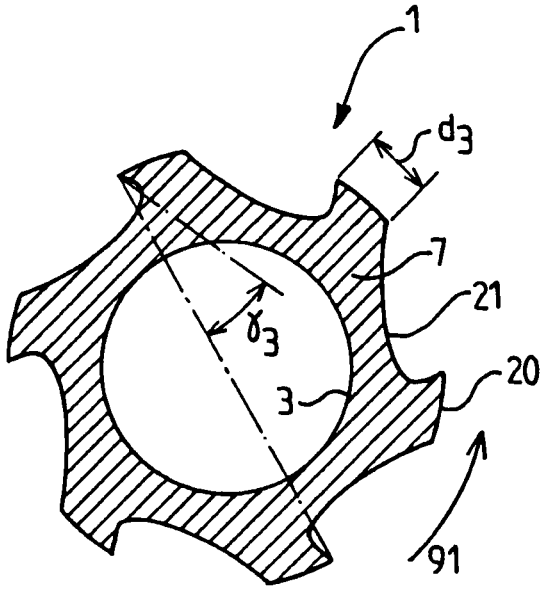
FIG. 5 is a sectional view along 5-5 of FIG. 1.

The grooves 17 illustrated in section in FIG. 4 have an leading edge in the direction of rotation of the drill pipe section with an obtuse angle with respect to the external surface of revolution of the activation zone 16 and an acute angle on the trailing side, which is complementary to $\gamma_2$, for example in the range 50° to 80°, preferably in the range 60° to 70°, for example 65°. The distance $d_2$ between two grooves 17 may be in the range 10 to 50 mm, preferably in the range 20 to 40 mm, for example 30 mm in the zone where said distance is a minimum.

Beyond the activation zone 16, the end section 6 may comprise a tapered elevator zone 92 (intended to support the drill pipe when it is lifted and maintained by the elevator of the drilling rig before it is connected to another drill pipe) which is tangential to the external surface of the activation zone 16, then a connection zone 18 with a cylindrical external surface up to its end which is welded to the central section 8.

The shape of the upstream end section 7 (male tool joint) is, very generally, symmetrical to that of the end section 6. The end section 7 comprises on its external surface in the direction of the arrow 4 a connection zone 19, an activation zone 20 provided with grooves 21, a bearing zone 22 comprising a downstream guide portion 23, a central bearing portion 24 and an upstream guide portion 25, an activation zone 26 provided with grooves 27 and a male connection zone 28.

More precisely, the connection zone 19 is shaped as an external cylindrical body of revolution fixed on one side by welding to the central section 8 and on the opposite side tangentially to the activation zone 20. The activation zone 20 is provided with grooves 21 which are four to eight in number, for example six. The grooves 21 may have geometrical characteristics viewed in section illustrated in FIG. 5 which are close to the geometrical characteristics of the grooves 17, but are, however, slightly shallower in depth. The activation zone 20 provides a recirculation effect for mud and debris during drilling (drop-in of the drill pipe section) and scrapes or back reams the hole on lifting the drill pipe section.

Figure 8:
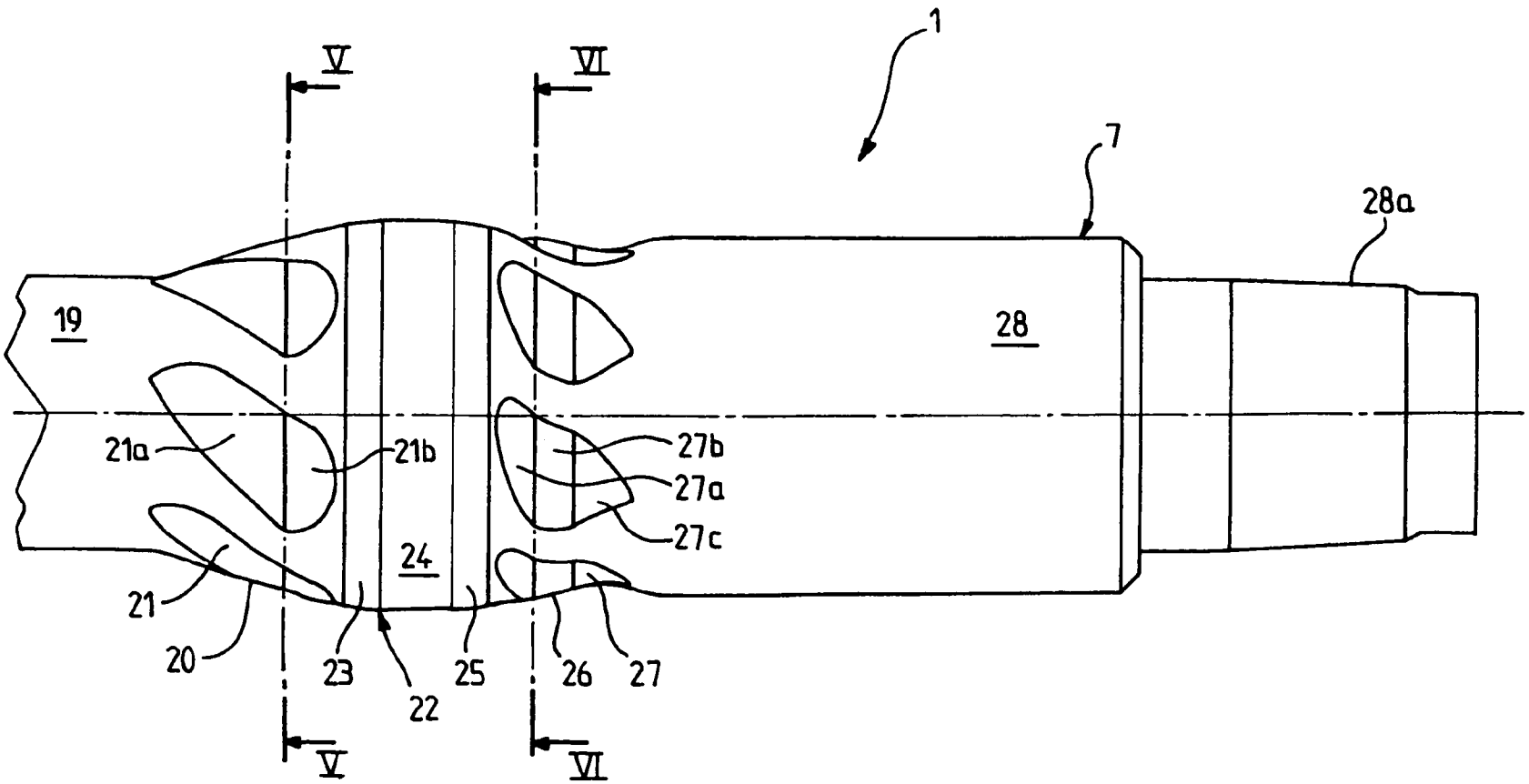
FIG. 8 is a partial detailed view of FIG. 1.

Viewed in axial section, see FIGS. 2 and 8, the grooves 21 comprise two principal portions instead of three for grooves 11 and 17. The grooves 21 comprise a downstream portion 21*a* located in the extension of the external surface of the connection zone 19 in order to maintain a thickness of the wall of the drill pipe at the portions 21*a* of the grooves 21 which is at least equal to that of the wall of the connection zone 19. In other words, in the downstream zone 21*a*, the bottom of the grooves 21 is substantially flat. Beyond the downstream portion 21*a*, the grooves 21 comprise an upstream portion 21*b* which is inclined in order to join the external diameter of the activation zone 20. The upstream portion 21*b* may have an angle of inclination $\beta_3$ with respect to the axis 2 which is in the range 30° to 60°, preferably in the range 40° to 50°, for example 45°. The external surface of the activation zone 20 has a generally domed shape, for example ogival, between the connection zone 19 and the bearing zone 22. The axial length of the downstream portion 21*a* may be in the range 50 to 100 mm, preferably in the range 60 to 80 mm, more preferably again less than the mean diameter of the guide sections. The distance $d_3$ between the grooves 21 may be equal to the distance $d_2$.

The bearing zone 22 may have geometrical, physical and/or chemical characteristics which are similar to those of the bearing zone 12. The downstream guide section 23 is tangential to the external surface of the activation zone 20 and to the external surface of the bearing portion 22. The upstream guide section 25 is tangential to the external surface of the activation zone 26 and to the external surface of the bearing portion 22.

The activation zone 26 comprises a plurality of grooves 27, for example five to ten in number, for example seven. The external surface of the activation zone 26 comprises a portion with an increasing diameter in the direction of the arrow 5 then a portion with a decreasing diameter connecting to the external diameter of the connection portion 28. The bottom of the grooves 27 comprises a downstream portion 27*a* with an increasing diameter in the direction of the arrow 5, a central cylindrical bottom portion 27*b* and an upstream portion 27*c* with a decreasing diameter in the direction of the arrow 5. The downstream portion 27*a* may have an angle $\beta_4$ with respect to the axis 2 in the range 30° to 60°, preferably in the range 40° to 50°, for example 45°. The upstream portion 27*c* may have an angle $\alpha_4$ with respect to the axis 2 in the range 10° to 30°, preferably in the range 15° to 25°, for example 20°. The diameter of the central portion 27*b* may be in the range from the diameter of the central portion 11*b* of the grooves 11 to the diameter of the central portion 17*b* of the grooves 17. The axial length of the central portion 27*b* may be in the range 10 to 50 mm, preferably in the range 20 to 30 mm. The axial length of the upstream portion 27*c* may be in the range 20 to 80 mm, preferably in the range 40 to 60 mm, for example 53 mm. The activation zone 26 scoops up and recirculates mud and debris during drilling (drop-in of drill pipe section). To increase the axial speed of the mud between the upstream 26 and the downstream activation zone 20 and thus the rise of debris, the inclination to the axis of the helix of the grooves 21 located downstream of the grooves 27 may be less than that of the grooves 27.

Figure 6:
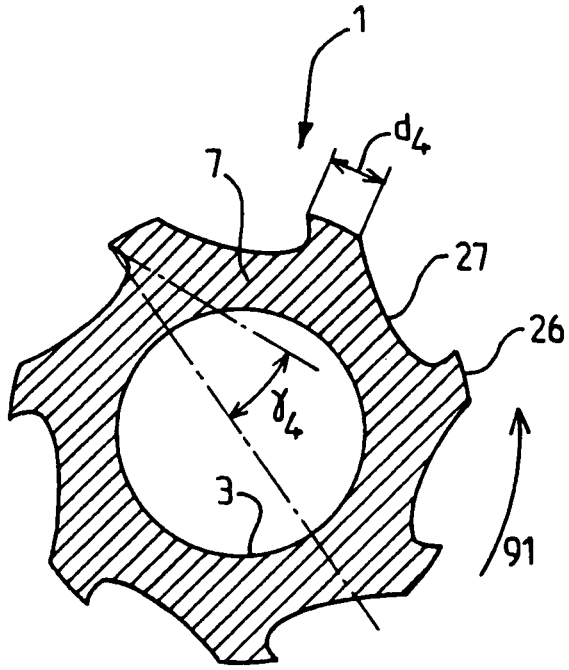
FIG. 6 is a sectional view along 6-6 of FIG. 1.
Figure 7:
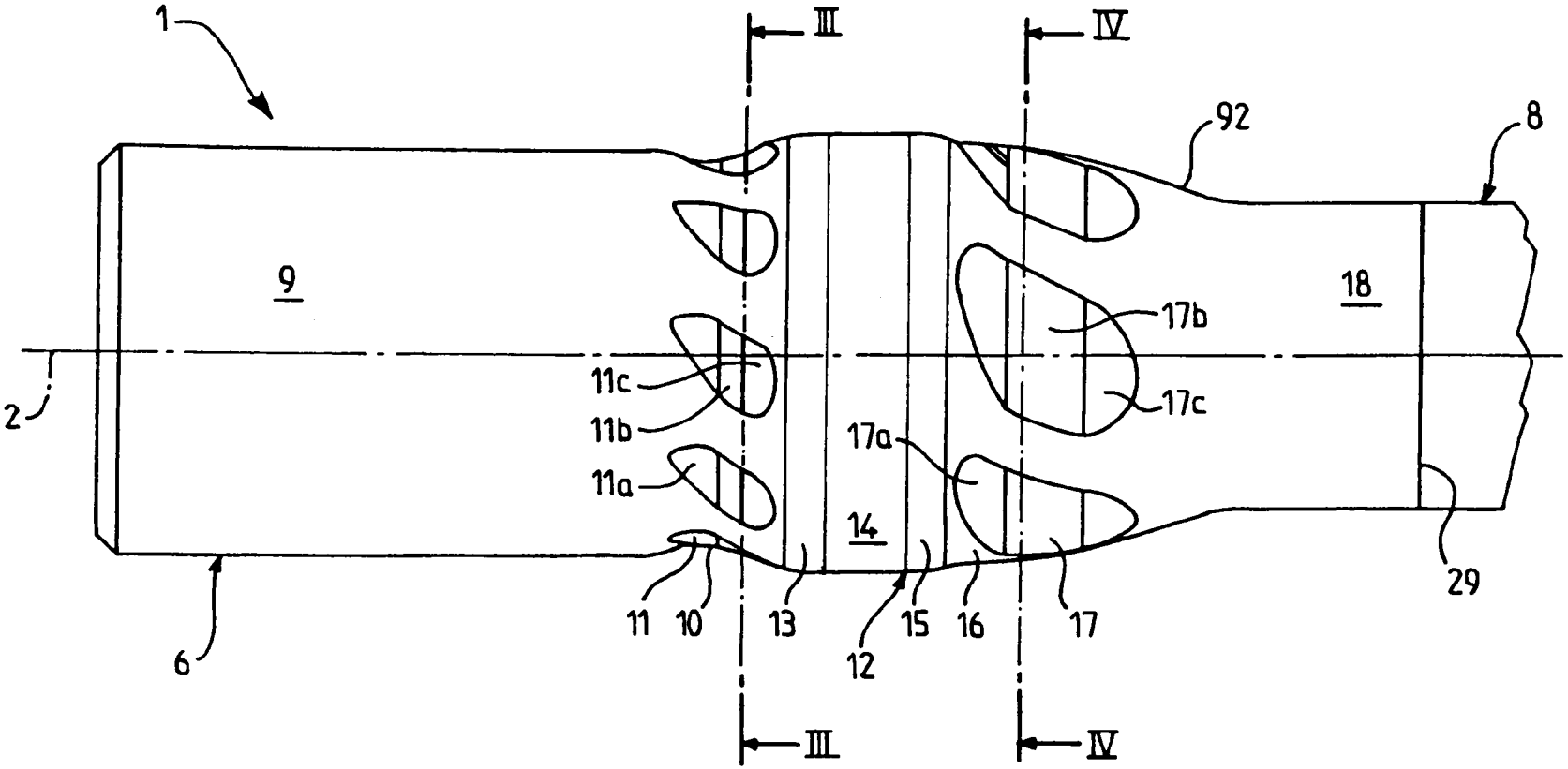
FIG. 7 is a partial detailed view of FIG. 1.

Viewed in cross section, see FIG. 6, the grooves 27 have an leading edge in the direction of rotation of the drill pipe section with an obtuse angle with respect to the external circumference of the activation zone 26 and an acute angle on the trailing edge side which is complementary to $\gamma_4$, for example with an angle in the range 50° to 80° with respect to the external circumference, preferably in the range 60° to 70°, for example 65°. The depth of the grooves 27 may be in the range 15 to 30 mm, preferably in the range 20 to 25 mm. The distance $d_4$ between the grooves may be in the range 10 to 40 mm, preferably in the range 20 to 35 mm, for example 25 mm.

The connection zone 28 upstream of the activation zone 26 has the external shape of a cylindrical body of revolution. The connection zone 28 also comprises a male thread 28*a* provided to cooperate with a corresponding female thread.

In the embodiment shown, the profiled element 1 comprises two bearing zones 12 and 22 separated from each other and each surrounded by two activation zones, respectively 10 and 16, and 26. The distance between the bearing zones 12 and 22 may be relatively large, for example of the order of 5 to 15 m depending on the length of the profiled element 1. It is advantageous to fabricate the profiled drill pipe 1 in distinct sections 6, 7 and 8. The central section 8, which is in the form of a body of revolution with a maximum diameter which is substantially smaller than the maximum diameter of the end sections 6 and 7 (tool joints), may be fabricated from a tubular blank with a substantially smaller external diameter, for example of the order of 15% to 30% of the external diameter of the end sections 6 and 7. Thus, the quantity of material to be machined is reduced considerably compared with a drill pipe 1 produced from a monoblock blank. The sections 6, 7 and 8 are welded together, for example by friction, before or after machining the grooves of the activation zones and before or after formation of the hard reinforcement of the bearing zones 12 and 22.

A drill string may be composed of drill pipes 1 to which other elements such as cross-over subs, or heavy weight drill pipes, drill collars or stabilizers may or may not be added. It is particularly advantageous to compose a string and more particularly a drill pipe section from a high proportion of drill pipes 1 ensuring excellent drilling characteristics, especially as regards linear advance speed, a low entrainment torque and little abrasion of the drilled hole. The activation zones 10, 16, 20 and 26 cause the drilling mud and the debris located outside the drill pipe 1 to move with a scraping or back-reaming effect, especially in the case of substantially horizontally deflected wells in which the drilling debris tends to become sedimented in the lower portion of the drilled hole. The activation zones can pick up this sediment and tend to lift it in the direction of the arrow 5 because of their helical inclination and the direction of rotation of the drill string. In general, the bearing zone 12, 22 is produced from a material which is harder than that of the remainder of the drill pipe 1 and over a radial thickness such that the external diameter of the bearing section reduced by double the radial thickness is greater than the external diameter of a threaded portion of the element.

At least one guide section may have a toroidal shape, preferably with a mean radius of more than 20 mm, preferably more than 60 mm, in order to form a fluid bearing.

At least one activation zone may have an external diameter which increases towards the bearing zone.

At least one guide section may have an ogival or ellipsoidal shape.

The length of the bearing section may be in the range 20 to 50 mm, preferably in the range 30 to 40 mm.

The length of the bearing zone may be in the range 50 to 100 mm, preferably in the range 70 to 80 mm, more preferably less than the mean radius of the guide sections.

Figure 15:
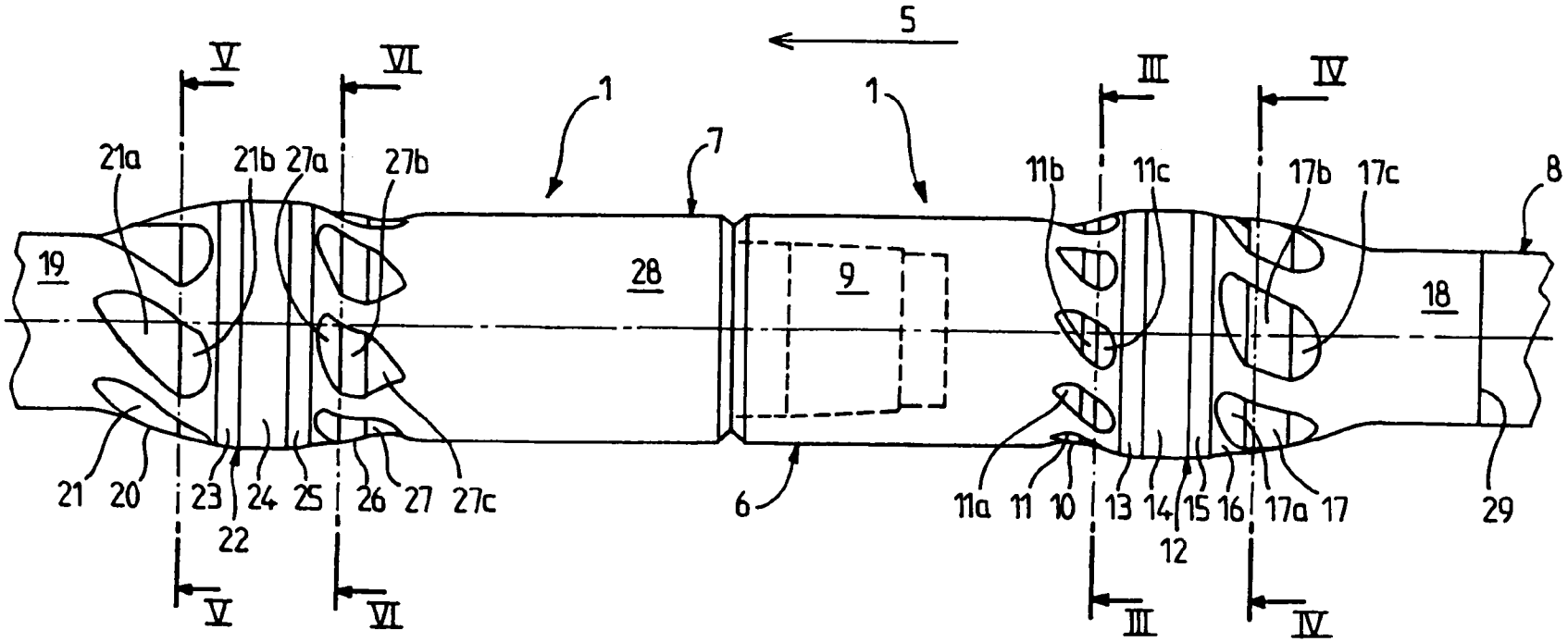
FIG. 15 shows the connected drill pipes of FIGS. 7 and 8.

FIG. 15 shows an assembly of two drill pipes 1 via their threads 9*a* and 28*a*. The bearing zone 12 and the activation zones 10, 16 of one of the drill pipes are relatively close to the bearing zone 22 and the activation zones 20 and 26 of the other drill pipe (distance of the order of less than 0.50 m). Because of the direction of circulation 5 of mud and debris outside the drill pipe section, the mud and debris initially encounter the activation zone 16, then the bearing zone 12 then the activation zone 10, then after a few tens of cm the activation zone 26, then the bearing zone 22 and finally the activation zone 20.

Because of the proximity of these zones, it may be advantageous to try and increase the axial speed of the mud and debris along these various zones. To this end, it is possible to select an angle of inclination of the grooves such that this angle reduces regularly from the most upstream grooves 17 to the most downstream grooves 21. In other words, the angle of inclination of the grooves 21 may be selected so as to be lower than that of the grooves 27, the angle of inclination of the grooves 27 may be selected so as to be lower than that of the grooves 11 and the angle of inclination of the grooves 11 may be selected so as to be lower than that of the grooves 17.

Figure 10:
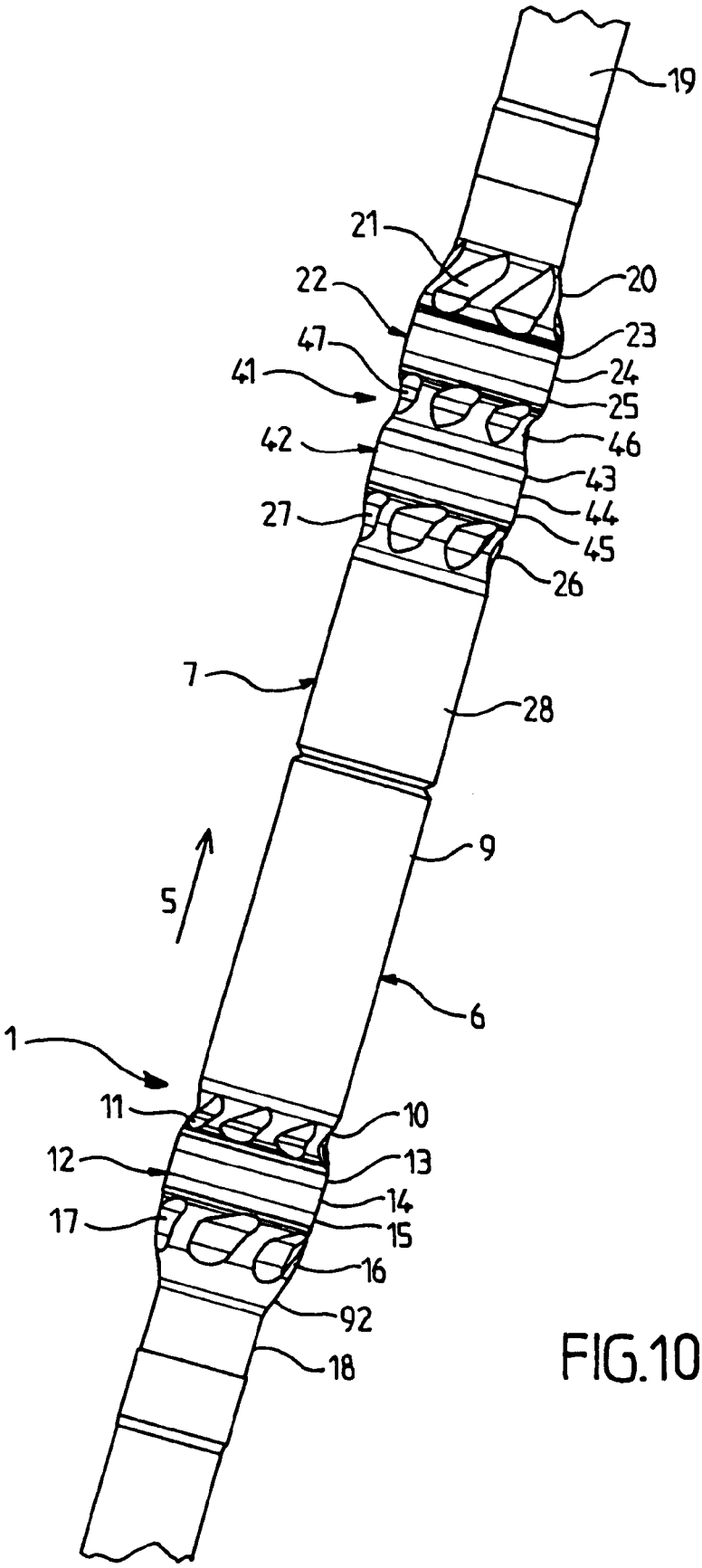
FIG. 10 is a partial side view of two elements on the coupled ends of two drill pipes.

A drill pipe 41 may comprise an end section 7 (male tool joint) comprising an activation zone 20 downstream of a downstream bearing zone 22, an activation zone 26 upstream of an upstream bearing zone 42 and an activation zone 46 between said downstream and upstream bearing zones, see FIG. 10. The pipe 41 offers increased activation of mud and excellent slipping over the walls of the well.

Figure 9:
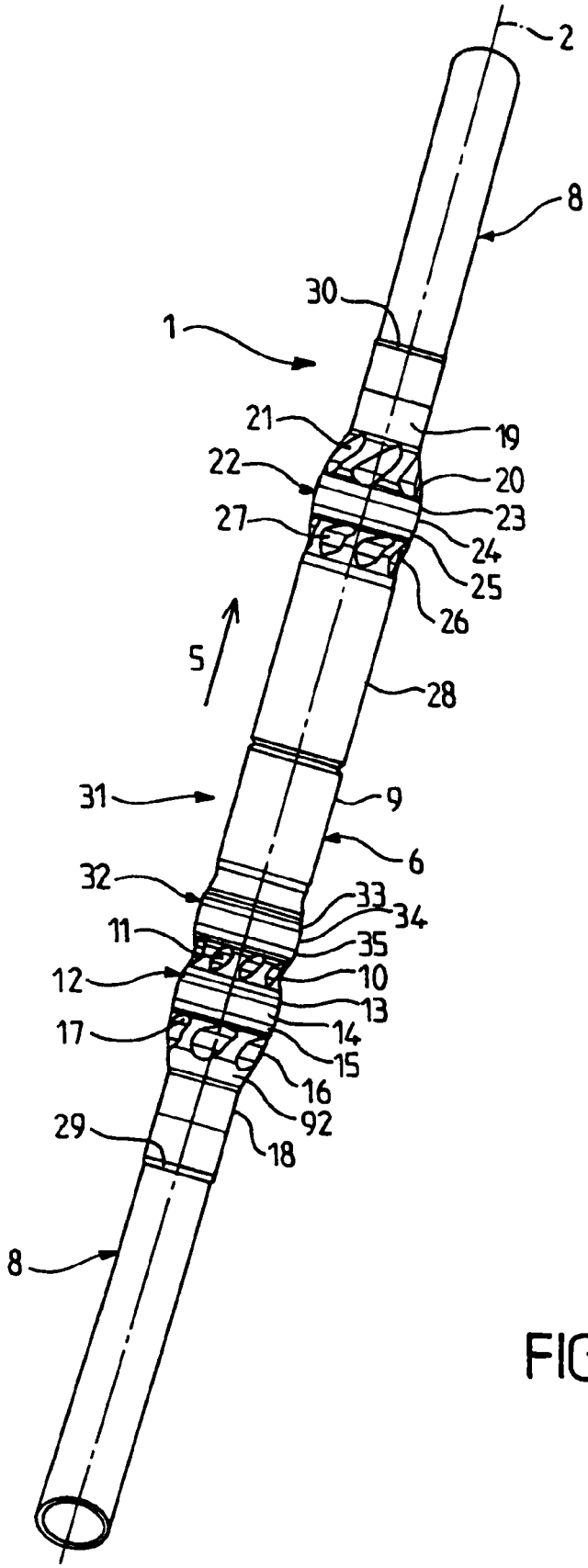
FIG. 9 is a partial side view of two elements on the coupled ends of two drill pipes.

A drill pipe 31 may comprise a section 6 (female tool joint) comprising an activation zone 16 upstream of an upstream bearing zone 12 and an activation zone 11 between a downstream bearing zone 32 and said upstream bearing zone 12, see FIG. 9. The section 31 thus comprises two bearing zones and two activation zones.

Figure 11:
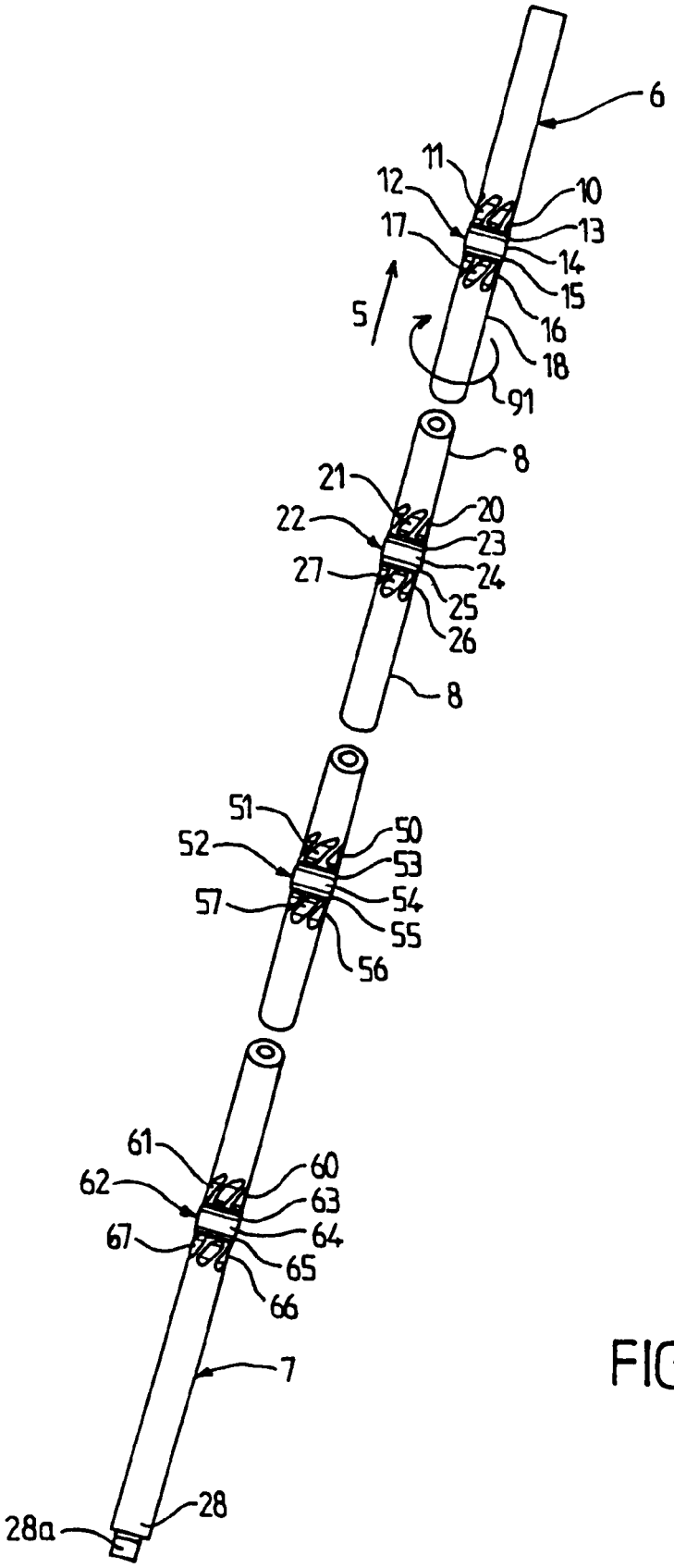
FIG. 11 is a side view of a drill collar with four bearing sections.

In the embodiment shown in FIG. 11, the profiled element 1 is a drill collar. The profiled element 1 comprises four bearing zones 12, 22, 52 and 62, each surrounded by activation zones 10 and 16, 20 and 26, 50 and 56 and 60 and 66.

Figure 12:
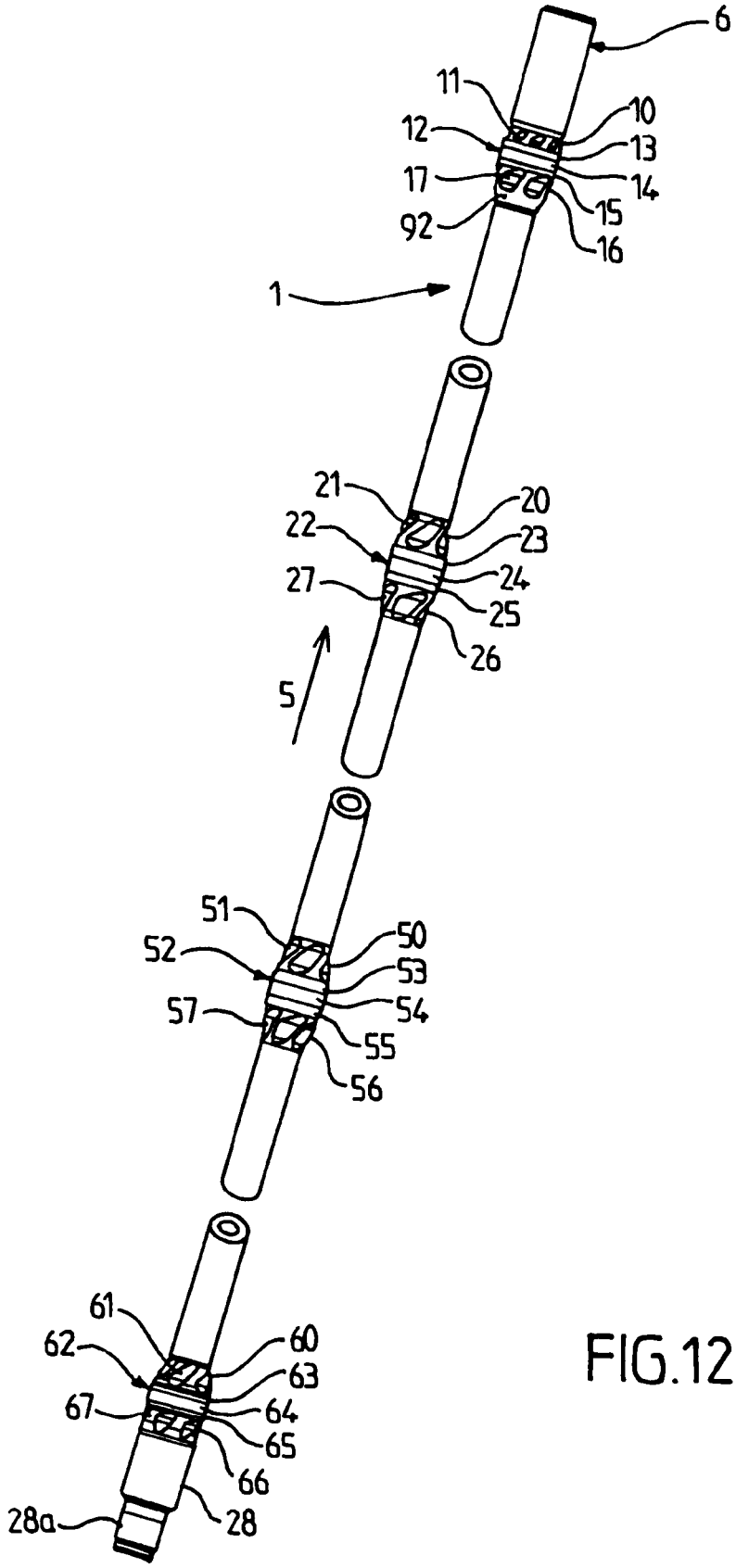
FIG. 12 is a side view of a heavy weight drill pipe with four bearing sections.

In the embodiment of FIG. 12, the profiled element 1 is a heavy weight drill pipe. The profiled element 1 comprises four bearing zones 12, 22, 52 and 62, each surrounded by activation zones 10 and 16, 20 and 26, 50 and 56 and 60 and 66.

Figure 13:
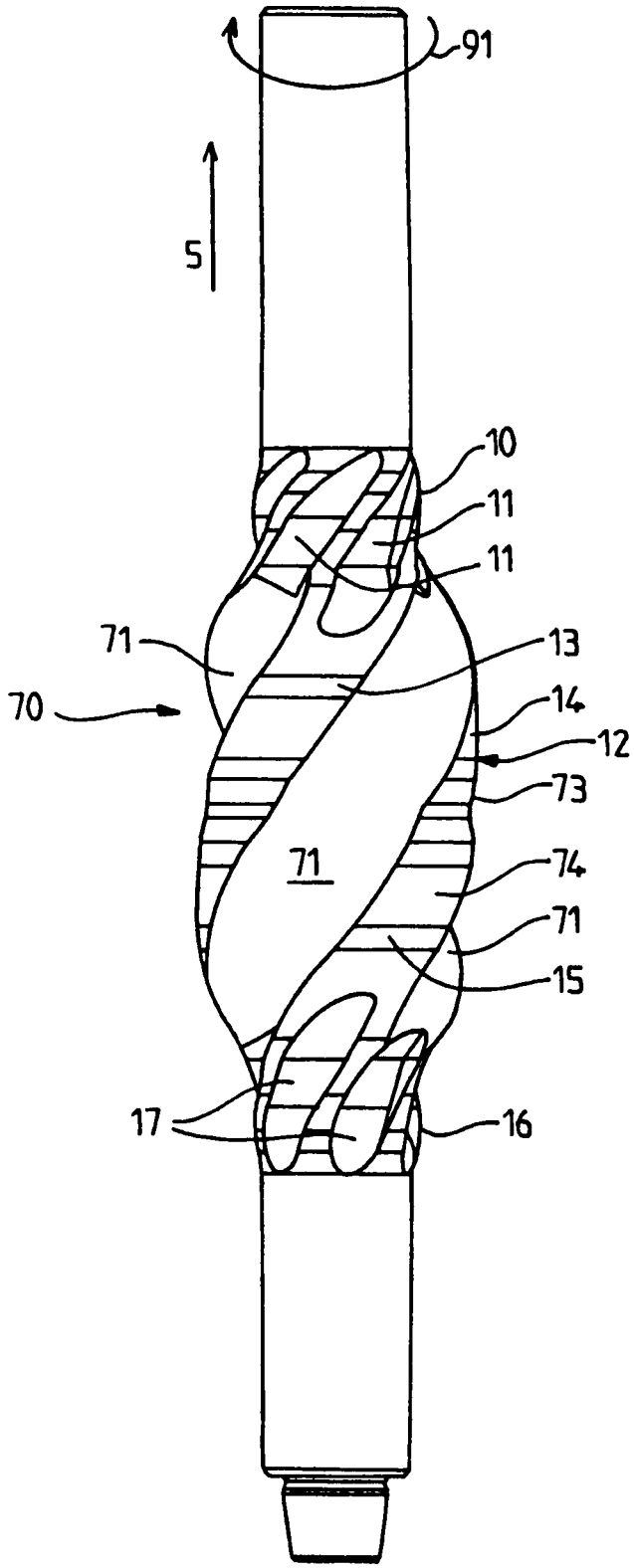
FIG. 13 is a side view of a drilling stabilizer with bearing sections.

In the embodiment of FIG. 13, there is provided a stabilizer 70, for example disposed beneath the lower end of a drill pipe section. The stabilizer 70 comprises a male thread at one end and a female thread at another end.

The stabilizer 70 comprises on its external surface a bearing zone 12 comprising two bearing sections, downstream 14 and upstream 74, and two activation zones 10 and 16 downstream and upstream of the bearing zone 12. The bearing zone 12 comprises two guide sections 13, 15 respectively between the activation zone 10 and the downstream bearing section 14 and between the activation zone 16 and the upstream bearing section 74. The bearing zone 12 comprises a linking section 73 between the downstream bearing section 14 and the upstream bearing section 74. The linking section may have an external diameter which is smaller than the external diameter of the bearing sections 14 and 74. The external diameter of the activation zone 10 may be different from the external diameter of the activation zone 16.

The stabilizer 70 comprises a first tubular portion between the male thread and the bearing zone 12 and a second tubular portion between the female thread and the bearing zone 12. The external diameter of each tubular portion is less than the maximum diameter of the bearing zone 12, preferably 65% less than the maximum diameter of the bearing zone 12. The external diameter of the first tubular portion may be greater than or equal to the external diameter of the second tubular portion. The length of the first tubular portion may be in the range 254 to 1219 mm.

Flutes 71 which are generally helical in shape may be provided at least in the bearing zone 12 to constitute blades 75 of the stabilizer between the flutes 71. The flutes 71 extend at least from the downstream bearing section 14 to the upstream bearing section 74. The flutes 71 may be two to six in number, for example three. The flutes 71 have an angle of inclination with respect to the axis 2 in the range 15° to 35° The angle of inclination may be in the range between the angle of inclination of the grooves 11 of the activation zone 10 and the angle of inclination of the grooves 17 of the activation zone 16. The flutes 71 may extend from the activation zone 10 to the activation zone 16. The flutes 71 may open at their ends into at least a portion of the grooves 11 and 17, for example three of the six. The flutes 71 serve to circulate drilling mud; the external diameter of the stabilizer may be close to that of the drilled hole and at least some of the blades 75 come to bear against the internal surface of the hole.

Figure 14:
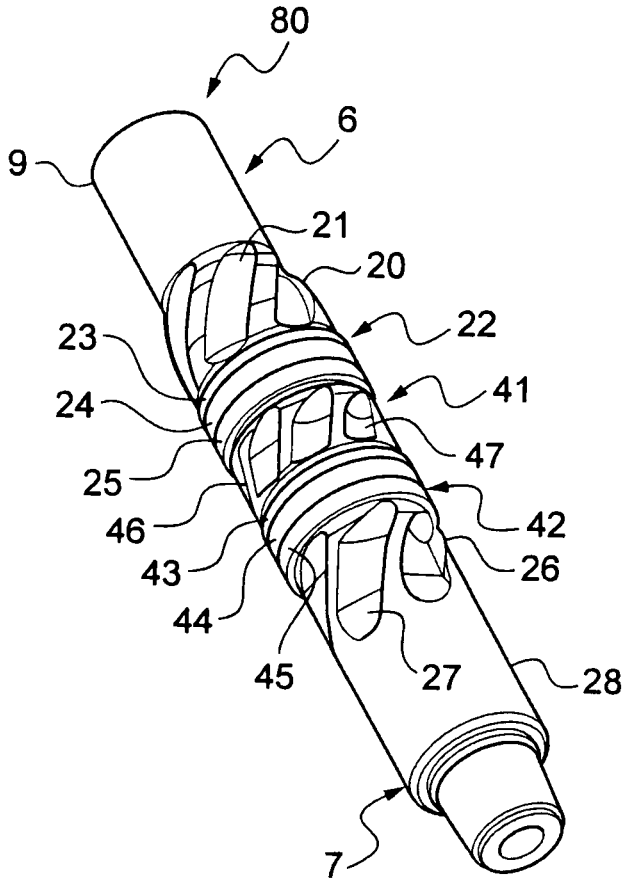
FIG. 14 is a side view of a connection piece usually termed a cross-over sub.

In the embodiment of FIG. 14, a connection piece or cross-over sub 80 is free of flutes 71. The cross-over sub 80 may have a bearing zone 41 similar to that shown in FIG. 10, a male thread at one end and a female thread at another end, a first tubular portion between the male thread and the bearing zone 41 and a second tubular portion between the female thread and the bearing zone 41. The external diameter of each tubular portion is less than the maximum diameter of the bearing zone 12 which may itself be much smaller than the diameter of the drilled hole. The inertia of the first and second tubular portions may be close to the inertia of the ends of the components adjacent to them. Thus, if the component adjacent to the first portion is a drill collar, the inertia of the first portion may be close to that of the drill collar. If the component adjacent to the second portion is a heavy weight drill pipe, the inertia of the second portion may be close to that of the heavy weight drill pipe.

Each stabilizer 70 or cross-over sub 80 may act as a connector between a bottom hole assembly (or BHA) and a drill pipe section which may have heavy weight drill pipes at its lower end. In one embodiment, a stabilizer 70 or cross-over sub 80 is disposed between a heavy weight drill pipe (or standard drill pipe if a heavy weight drill pipe is not used) which forms part of a drill pipe section and a drill collar or another component forming part of the bottom hole assembly. More particularly, the external diameter of the upper tubular portion of the drill collar may be different from the external diameter of the first tubular portion of the stabilizer 70 or the cross-over sub 80. The external diameter of the lower tubular portion of the heavy weight drill pipe may be different from the external diameter of the second tubular portion of the stabilizer 70 or the cross-over sub 80. It should be noted that the stabilizers are ordinarily disposed within the bottom hole assembly (for example towards the lower and upper ends). The positioning of a stabilizer 70 or a cross-over sub 80 between the drill pipe section and the bottom hole assembly offers particular advantages during backreaming operations for lifting the drill string. In a standard configuration (without a component of type 70, 80 between the bottom hole assembly and the drill pipe section), an accumulation of debris or a "dune" tends to be formed just above the bottom hole assembly under backreaming drill string lifting conditions. The inventors have noted the particularly beneficial influence on the evacuation of debris by disposing at least one component 70, 80 between the bottom hole assembly and the drill pipe section. Further, a cross-over sub 80 may allow a transition to be made between the high inertia of a drill collar of the bottom hole assembly and the lower inertia of a heavy weight drill pipe or a standard drill pipe section.

More generally, grooves 11, 17, 21, 27 may comprise a bottom portion which is inclined in a plane intersecting the axis close to the adjacent bearing zone, the inclination of this plane with respect to the axis being in the range 30° to 60°, preferably in the range 40° to 50°.

At least a portion of grooves 11, 17, 21, 27 may comprise a central portion the bottom of which is in a plane substantially parallel to the axis.

A drill pipe may comprise a substantially tubular portion between an activation zone upstream of a first bearing zone and an activation zone downstream of a second bearing zone.

The grooves of the activation zone upstream of the second bearing zone may comprise an inclined portion distant from the adjacent bearing zone the bottom of which is inclined in a plane intersecting the axis. The inclination of this plane with respect to the axis may be in the range 10° to 30°, preferably in the range 15° to 25°.

The grooves of the activation zone upstream of the second bearing zone may comprise a portion distant from the bearing zone the bottom of which is inclined in a plane intersecting the axis and with a length in the range 20 to 80 mm, preferably in the range 40 to 60 mm, and a central portion the bottom of which is in a plane substantially parallel to the axis, with a length in the range 10 to 50 mm, preferably in the range 20 to 30 mm.

The grooves of the activation zone downstream of the second bearing zone may comprise a portion the bottom of which is in a plane substantially parallel to the axis, with a length in the range 50 to 120 mm, preferably in the range 70 to 80 mm.

The grooves of the activation zone downstream of the second bearing zone may comprise a portion the bottom of which is in a plane substantially parallel to the axis and tangential to an external surface of a substantially tubular surface.

The grooves of the activation zone upstream of the first bearing zone may comprise a portion distant from the adjacent bearing zone the bottom of which is inclined in a plane intersecting the axis. The inclination with respect to the axis may be in the range 10° to 30°, preferably in the range 15° to 25°.

The grooves of the activation zone upstream of the first bearing zone may comprise a portion distant from the adjacent bearing zone the bottom of which is inclined in a plane intersecting the axis and with a length in the range 10 to 60 mm, preferably in the range 20 to 30 mm, and a central substantially axial portion with a length in the range 10 to 80 mm, preferably in the range 30 to 40 mm.

The grooves of the activation zone downstream of the first bearing zone may comprise a portion distant from the adjacent bearing zone the bottom of which is inclined in a plane intersecting the axis, the inclination with respect to the axis being in the range 10° to 30°, preferably in the range 15° to 25°.

The grooves of the activation zone downstream of the first bearing zone may comprise a portion distant from the adjacent bearing zone the bottom of which is inclined in a plane intersecting the axis and with a length in the range 10 to 70 mm, preferably in the range 35 to 45 mm, and a central substantially axial portion with a length in the range 5 to 40 mm, preferably in the range 10 to 15 mm.

The product of the depth of a groove and the number of grooves of an activation zone may be in the range 80 to 200 mm, preferably in the range 100 to 160 mm.

The grooves of the activation zones may, with the external surface of the activation zone, form an acute angle with one edge and an obtuse angle with the opposite edge in the circumferential direction and with respect to the external circumference of the activation zone. The acute angle may have a value in the range 60° to 70°.

The distance between two grooves of an activation zone may be in the range 10 to 50 mm, preferably in the range 20 to 35 mm.

The depth of a groove of an activation zone may be in the range 10 to 40 mm, preferably in the range 11 to 28 mm.

The grooves have the general shape of a helix with an angle with respect to the axis which decreases from upstream to downstream of a bearing zone.

A section as described above may be provided with a threaded connection at one of its ends and be free of a thread at the other end. Thus, a drill pipe section may comprise at least one section of this type (constituted, for example, from a tool joint) and a tube one end face of which is welded to the end which is free of a thread on said section (butt welding). The drill pipe section may comprise two sections connected via a tube welded by its end faces to the end which is free of a thread on each section. A drill pipe section comprising at least 80% drill pipes according to the invention, or even 100%, may be formed.

We have here a drill pipe section element which can considerably improve drilling performance, especially an increase in the rate of advance of the order of 10% to 30%, a reduction in the frictional torque of the order of 10% to 60%, a reduction in the axial friction of the order of 10% to 50%, an increase in the service life of the drill pipe section of the order of 10% to 30% and an increase in the total length of the drilled hole of the order of 1 to 2 km.

The invention claimed is:

1. An element of a drill string for drilling a hole with circulation of a drilling fluid around the element and in a direction moving from a bottom of a drilled hole towards a surface, comprising:

at least one zone for bearing on a wall of the hole during drilling, the bearing zone including externally at least one bearing section with an external diameter greater than the diameter of other portions of the element, and two first and second activation zones substantially adjacent to the bearing zone and disposed upstream and downstream of the bearing zone, respectively, the upstream and downstream being defined with respect to the direction of circulation of fluid around the element, the activation zones comprising a plurality of grooves generally helical in shape about the axis of the element, wherein the bearing zone comprises first and second guide sections in a form of a convex rounded body of revolution, disposed upstream and downstream of the bearing section and adjacent to the bearing section, respectively, the guide sections being externally tangential to the bearing section and to the activation zones, and wherein a diameter of the element adjacent to and upstream of the first activation zone and a diameter of the element adjacent to and downstream of the second activation zone are less than the external diameter of the bearing section.

2. An element according to claim 1, which is free of a thread at one end of the element and is provided with a thread at another end of the element.

3. A drill pipe comprising:

two elements in accordance with claim 2; and a substantially tubular portion fixed to the elements between an activation zone upstream of a first bearing zone and an activation zone downstream of a second bearing zone.

4. A drill pipe according to claim 3, in which the grooves of the activation zone upstream of the second bearing zone comprise a portion distant from the adjacent bearing zone with a bottom inclined in a plane that intersects the axis, the inclination of the intersecting plane with respect to the axis being in a range of 10° to 30°.

5. A drill pipe according to claim 4, in which the inclination of the intersecting plane with respect to the axis is in a range of 15° to 25°.

6. A drill pipe according to claim 3, in which the grooves of the activation zone upstream of the second bearing zone comprise a portion distant from the adjacent bearing zone with a bottom inclined in a plane intersecting the axis and with a length in a range of 20 to 80 mm , and a central portion with a bottom in a plane substantially parallel to the axis with a length in a range of 10 to 50 mm.

7. A drill pipe according to claim 6, in which the length of the portion distant from the adjacent bearing zone with a bottom inclined in a plane intersecting the axis is in a range of 40 to 60 mm, and the length of the central portion with a bottom in a plane substantially parallel to the axis is in a range of 20 to 30 mm.

8. A drill pipe according to claim 3, in which the grooves of the activation zone downstream of the second bearing zone comprise a portion distant from the adjacent bearing zone with a bottom in a plane substantially parallel to the axis with a length in a range of 50 to 120 mm.

9. A drill pipe according to claim 8, in which the length of the portion distant from the adjacent bearing zone with a bottom in a plane substantially parallel to the axis is in a range of 70 to 80 mm.

10. A drill pipe according to claim 3, in which the grooves of the activation zone downstream of the second bearing zone comprise a portion distant from the adjacent bearing zone with a bottom in a plane substantially parallel to the axis and tangential to an external surface of a substantially tubular portion.

11. A drill pipe according to claim 3, in which the grooves of the activation zone upstream of the first bearing zone comprise a portion distant from the adjacent bearing zone with a bottom inclined in a plane which intersects the axis, the inclination of the intersecting plane being in a range of 10° to 30°.

12. A drill pipe according to claim 11, in which the inclination of the intersecting plane is in a range of 15° to 25°.

13. A drill pipe according to claim 3, in which the grooves of the activation zone upstream of the first bearing zone comprise a portion distant from the adjacent bearing zone with a bottom inclined in a plane intersecting the axis and with a length in a range of 10 to 60 mm, and a central portion with a bottom in a plane substantially parallel to the axis with a length in a range of 10 to 80 mm.

14. A drill pipe according to claim 13, in which the length of the portion distant from the adjacent bearing zone with a bottom inclined in a plane intersecting the axis is in a range of 20 to 30 mm, and the length of the central portion with a bottom in a plane substantially parallel to the axis is in a range of 30 to 40 mm.

15. A drill pipe according to claim 3, in which the grooves of the activation zone downstream of the first bearing zone comprise a portion distant from the adjacent bearing zone with a bottom inclined in a plane intersecting the axis, the inclination of the intersecting plane with respect to the axis being in a range of 10° to 30°.

16. A drill pipe according to claim 15, in which the inclination of the intersecting plane with respect to the axis is in a range of 15° to 25°.

17. A drill pipe according to claim 3, in which the grooves of the activation zone downstream of the first bearing zone comprise a portion distant from the adjacent bearing zone with a bottom inclined in a plane intersecting the axis and with a length in a range of 10 to 70 mm, and a central portion with a bottom in a plane substantially parallel to the axis with a length in a range of 5 to 40 mm.

18. A drill pipe according to claim 17, in which the length of the portion distant from the adjacent bearing zone with a bottom inclined in a plane intersecting the axis is in a range of 35 to 45 mm, and the length of the central portion with a bottom in a plane substantially parallel to the axis is in a range of 10 to 15 mm.

19. A drill pipe section comprising at least two drill pipes in accordance with claim 3.

20. A drill pipe comprising:

at least one element in accordance with claim 2, and a tube one end of which is welded to the end of the element that is free of a thread.

21. An element of a drilling string for drilling a hole with circulation of a drilling fluid around the element and in a direction from a bottom of a drilled hole towards a surface, the element forming a connection between a drill pipe section or a heavy weight drill pipe section and a bottom hole assembly, the element comprising:

a first end comprising an external surface with a first diameter and a female thread;

a second end comprising an external surface having a second diameter and a male thread, the first diameter being less than or equal to the second diameter; and at least one zone bearing on a wall of the hole during drilling, the bearing zone including at least one bearing section with a cylindrical external surface and with an external diameter greater than the diameter of other portions of the element, and first and second activation zones substantially adjacent to the bearing zone and disposed upstream and downstream of the bearing zone, respectively, the activation zones comprising a plurality of grooves generally helical in shape about the axis of the element, the bearing zone comprising first and second guide sections in a form of a convex rounded body of revolution, disposed upstream and downstream of the bearing section, respectively, and adjacent to the bearing section, the guide sections being tangential to the bearing section and to the activation zones, wherein a diameter of the element adjacent to and upstream of the first activation zone and a diameter of the element adjacent to and downstream of the second activation zone are less than the external diameter of the bearing section.

22. An element according to claim 21, further comprising flutes with a generally helical shape formed in at least the bearing zone to extend at least from a downstream bearing section to an upstream bearing section.

23. An element according to claim 22, in which the flutes are two to six in number, have an angle of inclination with respect to the axis in a range of 15° to 35°, extended from the second activation zone to the first activation zone, and ends of the flutes open into at least some of the groves.

24. An element according to claim 21, in which the bearing zone is produced from a material with a hardness which is greater than a hardness of a remainder of the element and an external diameter of the bearing zone is such that the external diameter of the bearing zone reduced by double the radial thickness is greater than an external diameter of a threaded portion of the element, at least one guide section having a toroidal shape with a mean radius in a range of 60 to 100 mm.

25. An element according to claim 24, in which the mean radius of the at least one guide section having a toroidal shape is in a range of 70 to 80 mm.

26. An element according to claim 21, in which at least one activation zone has an external diameter that increases toward the bearing zone.

27. An element according to claim 21, in which an least one guide section has an ogival or ellipsoidal shape.

28. An element according to claim 21, in which an angle of inclination with respect to an axis of a helix of the grooves of the second activation zone is smaller than a corresponding angle of the helix of the grooves of the first activation zone.

29. An element according to claim 21, in which the grooves comprise an inclined portion close to the adjacent bearing zone, the inclination with respect to the axis being in a range of 30° to 60°.

30. An element according to claim 29, in which the inclination with respect to the axis is in a range of 40° to 50°.

31. An element according to claim 21, in which at least some of the grooves comprise a central portion with a tubular shape.

32. An element according to claim 21, in which a product of the depth of a groove and the number of grooves of an activation zone is in a range of 80 to 200 mm.

33. An element according to claim 32, in which the product of the depth of a groove and the number of grooves of an activation zone is in a range of 100 to 160 mm.

34. An element according to claim 21, in which the grooves of at least one activation zone make an acute angle with one edge and an obtuse angle with the opposite edge in the circumferential direction.

35. An element according to claim 34, in which the acute angle has a value in a range of 20° to 30° with respect to a plane passing though the axis of the element and through the edge.

36. An element according to claim 21, in which the a distance between two grooves of an activation zone is in a range of 10 to 50 mm.

37. An element according to claim 36, in which the distance between two grooves of an activation zone is in a range of 20 to 35 mm.

38. An element according to claim 21, in which a depth of a groove of at least one activation zone is in a range of 10 to 40 mm.

39. An element according to claim 38, in which the depth of a groove of at least one activation zone is in a range of 11 to 28 mm.

40. An element according to claim 21, comprising three to five bearing zones.

41. An element according to claim 21, comprising an activation zone downstream of a downstream bearing zone, an activation zone upstream of an upstream bearing zone, and an activation zone between the downstream and upstream bearing zones.

42. An element according to claim 21, comprising an activation zone upstream of an upstream bearing zone and an activation zone between a downstream bearing zone and the upstream bearing zone.

43. A drill string comprising:

(i) a drill pipe section comprising, at its lower end, at least one heavy weight drill pipe;

(ii) a bottom hole assembly; and (iii) at least one element according to claim 21, forming a connection between a drill pipe of the drill pipe section and the bottom hole assembly.

* * * * *